US011452395B2

(12) United States Patent
Jesseph

(10) Patent No.: US 11,452,395 B2
(45) Date of Patent: Sep. 27, 2022

(54) MUSICAL INSULATED BEVERAGE COZY OR CONTAINER WITH ELECTRONIC SOUND RECORDING AND ON/OFF BUTTON

(71) Applicant: Bonnie Jesseph, Naples, FL (US)

(72) Inventor: Bonnie Jesseph, Naples, FL (US)

( * ) Notice: Subject to any disclaimer, the term of this patent is extended or adjusted under 35 U.S.C. 154(b) by 0 days.

(21) Appl. No.: 16/921,732

(22) Filed: Jul. 6, 2020

(65) Prior Publication Data

US 2021/0000273 A1 Jan. 7, 2021

Related U.S. Application Data

(60) Provisional application No. 62/870,182, filed on Jul. 3, 2019.

(51) Int. Cl.

| | |
|---|---|
| ***A47G 19/22*** | (2006.01) |
| ***A47G 23/02*** | (2006.01) |
| ***A47G 21/18*** | (2006.01) |
| ***B65D 81/38*** | (2006.01) |

(52) U.S. Cl.

CPC ..... *A47G 23/0216* (2013.01); *A47G 21/182* (2013.01); *B65D 81/3876* (2013.01)

(58) Field of Classification Search

CPC ..... A47G 23/0216; A47G 2200/143; A47G 2200/146; G08B 3/00; G08B 3/10; H04R 1/028

USPC ..... 220/676, 739; 340/692, 384.1, 384.7

See application file for complete search history.

(56) References Cited

U.S. PATENT DOCUMENTS

| | | | | |
|---|---|---|---|---|
| 3,462,157 | A | 8/1969 | Barnett et al. | |
| 3,798,806 | A | 3/1974 | Sanford | |
| 4,293,015 | A | 10/1981 | McGough | |
| 4,531,310 | A | 7/1985 | Acson et al. | |
| 4,607,747 | A | 8/1986 | Steiner | |
| 5,990,790 | A * | 11/1999 | Lusareta | A47G 23/0306 206/459.1 |
| 8,312,652 | B2 | 11/2012 | Mayer et al. | |
| 2011/0083259 | A1 * | 4/2011 | Wright | A41D 13/1192 4/261 |

* cited by examiner

*Primary Examiner* — King M Chu

(74) *Attorney, Agent, or Firm* — Haley Guiliano LLP

(57) ABSTRACT

A musical insulated beverage cozy or container is formed from a unitary member designed to embody an electrical sound synthesizer component. This sound synthesizer component is connected via insulated wire, on the interior of the embodiment, to an on-demand on/off button which the user can press to play or stop pre-loaded or user-recorded music or messages.

3 Claims, 8 Drawing Sheets

MUSICAL INSULATED BEVERAGE COZY OR CONTAINER WITH ELECTRONIC SOUND RECORDING AND ON/OFF BUTTON

CROSS REFERENCE TO RELATED APPLICATIONS

This is a non-provisional application of U.S. Provisional Application No. 62/870,182, filed Jul. 3, 2019, which is hereby incorporated by reference herein in its entirety.

FIELD OF THE INVENTION

The present invention is an insulated beverage cozy or beverage container embodying an electronical sound synthesizer component, which allows users to play pre-recorded music or to record their own audio, and to play and stop the sound on-demand by pushing a button.

BACKGROUND OF THE DISCLOSURE

Oftentimes, insulated beverage cozies and beverage containers are personalized with writing, logos, or pictures. The present invention advances this personalization of insulated beverage cozies and beverage containers by delivering pre-recorded music or messages, or personalized messages recorded by the user, that are electronically stored in a sound synthesizer component embodied in the insulated beverage cozy or beverage container. Other items, such as greeting cards, have incorporated pre-recorded music and messages as well as personalized messages recorded by the user. However, these goods automatically activate the audio when opened, and shut it off when closed. Utilizing the same technology would mean that audio would play whenever a drink was inserted into the cozy and continue playing until it was removed. The present invention advances this technology by incorporating an on-demand on/off button, so that when the audio is played is determined by the user, and not by their beverage.

U.S. Pat. No. 4,293,015 to McGough discloses an insulated beverage cozy. However, it does not disclose a capability to produce or record sound, nor does it disclose any design element that would embody an electrical component to enable such capabilities. U.S. Pat. No. 4,531,310, Acson, et al. discloses a button or badge having a voice or sound synthesizer circuit that is activated by closure of a switch. The audio sounds are embodied in a read-only memory (ROM) integrated circuit in the voice or sound synthesizer circuit. However, Acson does not disclose utilizing a personalized message that is stored in the ROM integrated circuit. Additionally, Acson does not disclose an on-demand on/off feature for the sound. Rather, the user must leave open any good embodying the button in order to hear the sound and cannot open the good without hearing the sound. Similarly, U.S. Pat. No. 4,607,747 to Steiner discloses a carton for gifts that includes an acoustic generator that is turned on when the carton is opened, and U.S. Pat. No. 3,462,157 to Barnett, et al. discloses an audible greeting card which incorporates a pick-up needle that moves across a sound-strip when opened.

U.S. Pat. No. 3,798,806 to Sanford discloses a musical greeting card, which activates a music box element on the back of the card upon opening and shuts it off upon closing. Sanford does not disclose any electrical components. U.S. Pat. No. 8,312,652 B2 to Mayer, et al. discloses a 'sing-along' greeting card containing electronic components including a recording module and a memory module, allowing at least one pre-recorded audio clip to be stored on the device, and also allowing users to record a message. However, like Steiner, Barnett, and Sanford, Mayer discloses a function by which opening/closing the greeting card will automatically activate or stop the play of the music or dialog and does not disclose any function that would provide an alternative.

OBJECTS OF THE INVENTION

It is an object of the present invention to provide a personalized insulated beverage cozy or beverage container that, upon pushing a button, emits audible sounds representative of a personalized message recorded by the user.

It is an object of the present invention to provide an insulated beverage cozy or beverage container that, upon pushing a button, emits audible sounds representative of music or a verbal message from the distributor of the cozy.

SUMMARY

The present invention comprises an insulated beverage cozy or beverage container, designed to embody an electrical component that stores audio, sounds, and music uploaded by the manufacturer or distributor, as well as audio recorded by the user. This electrical component is connected by wire to an on-demand on/off switch, located on the back of the insulated beverage cozy or container. The bottom of the insulated beverage cozy or container, or the part of the embodiment containing the sound synthesizer element, contains a number of holes to allow sound from the speaker to be emitted therefrom. For example, the part of the insulated beverage cozy or container containing the sound synthesizer element may have five or more holes for the speaker. The holes may be located in a face of the part of the beverage cozy or container that is parallel to the front face of the speaker.

BRIEF DESCRIPTION OF THE DRAWINGS

For a more complete understanding of the present disclosure, reference is now made to the following brief description, taken in connection with the accompanying drawings and detailed description, wherein like reference numerals represent like parts, and wherein.

DETAILED DESCRIPTION

Figure 1:
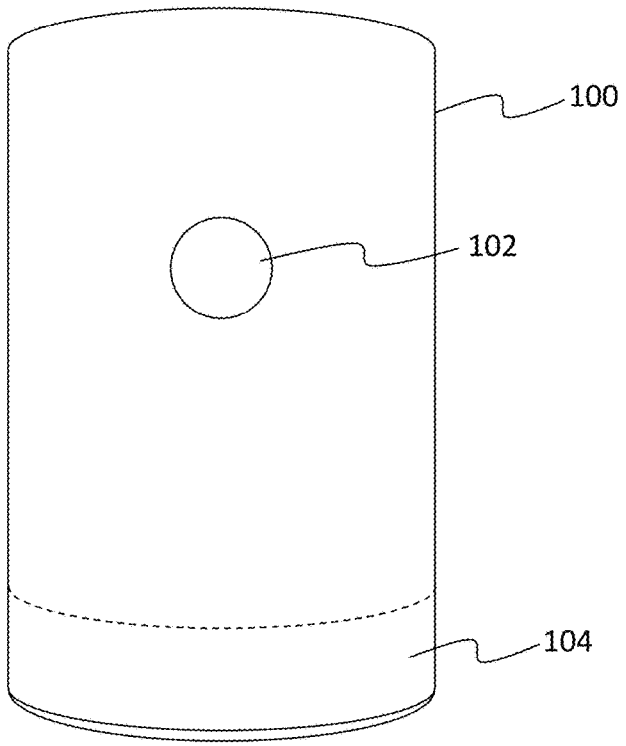
FIG. 1 depicts a first exterior frontal view of an insulated beverage container, in accordance with some embodiments of the present disclosure.

The following description of this invention is made with reference to one or more of the preferred embodiments as illustrated in the accompanying drawings. Elements which are common to each of the foregoing figures are assigned a common reference numeral.

FIGS. 1-4 depict various forms of the device of the present disclosure in its simplest form. The device illustrated therein is essentially an insulated beverage cozy or beverage container. FIG. 1 shows an insulated beverage cozy 100 configured to hold a twelve ounce beverage can, such as a soda can or a beer can. Insulated beverage cozy 100 is a unitary cylindrical member. Insulated beverage cozy 100 may be made of neoprene or some comparable material. Insulated beverage cozy 100 includes an externally marked area 102 covering an on-demand on/off button that, when pressed by a user, activates a sound synthesizer which plays a pre-recorded or user-recorded song or message. The on-demand on/off button may also be used to allow a user to record a song or message for playback. In some embodiments, insulated beverage cozy 100 contains false bottom 104 in which are concealed electronic components including the sound synthesizer, power source, speaker, and microphone. Insulted beverage cozy 100 may be sewn, silk-screened, printed, or embroidered. Insulated beverage cozy 100 may have an approximately 0.5-inch-deep groove in the top rear of the embodiment for receiving a user's mouth, whereby the user can drink their beverage without their mouth touching the insulated beverage cozy.

Figure 2:
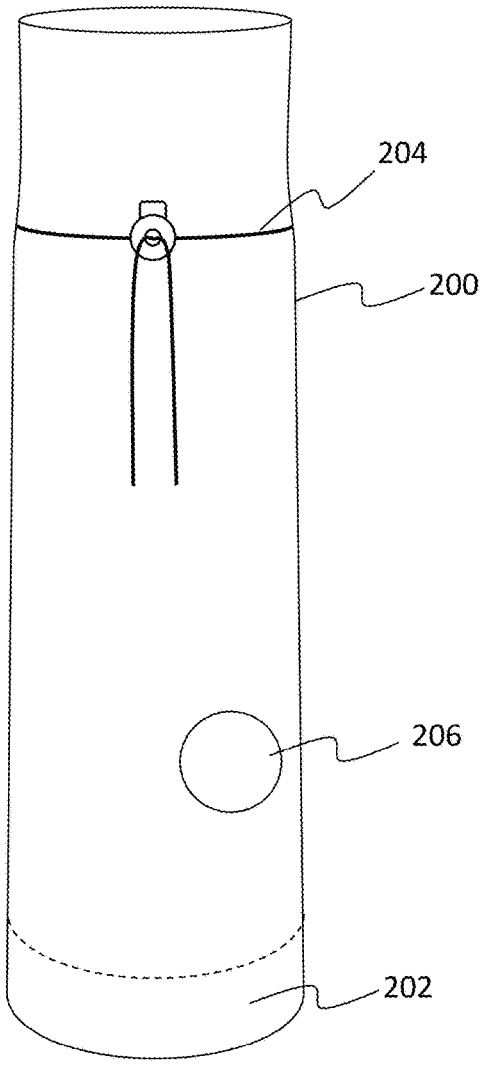
FIG. 2 depicts a second exterior frontal view of an insulated beverage container, in accordance with some embodiments of the present disclosure.

FIG. 2 depicts the device of the present disclosure in the form of insulated bag 200 configured to hold a wine bottle. Insulated bag 200 may also include a false bottom 202 in which electronic components are concealed. Drawstring 204 may be used to cinch the opening of inulated bag 200 around the neck of a wine bottle. Insulated bag 200 may be made of neoprene or any other suitable insulating material.

Figure 3:
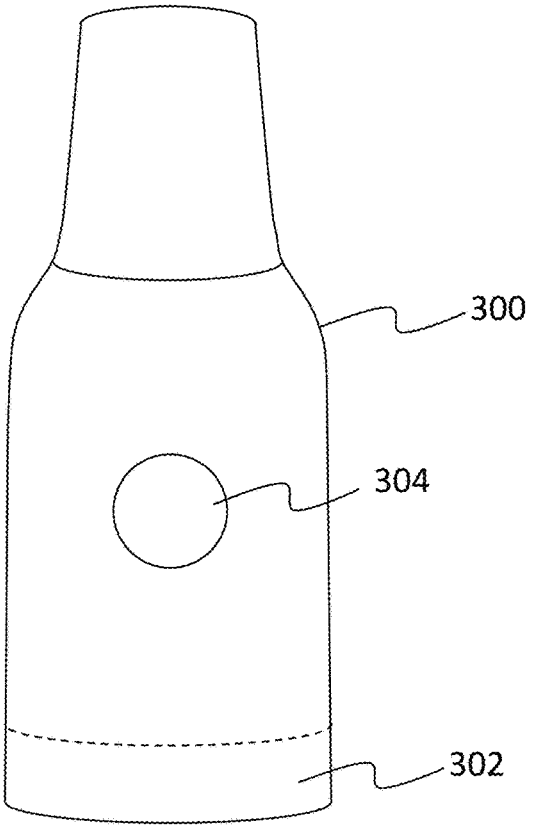
FIG. 3 depicts a third exterior frontal view of an insulated beverage container, in accordance with some embodiments of the present disclosure.

FIG. 3 depicts the device of the present disclosure in the form of insulated bottle cozy 300. Insulated bottle cozy 300 may be configured to hold a bottle of beer, a bottle of water, or any other bottled beverage of similar size. As with insulated beverage cozy 100 and insulated bag 200, insulated bottle cozy 300 may include false bottom 302 in which electronic components are concealed. Insulated bottle cozy 300 may be made of neoprene or any other suitable insulating material.

Figure 4:
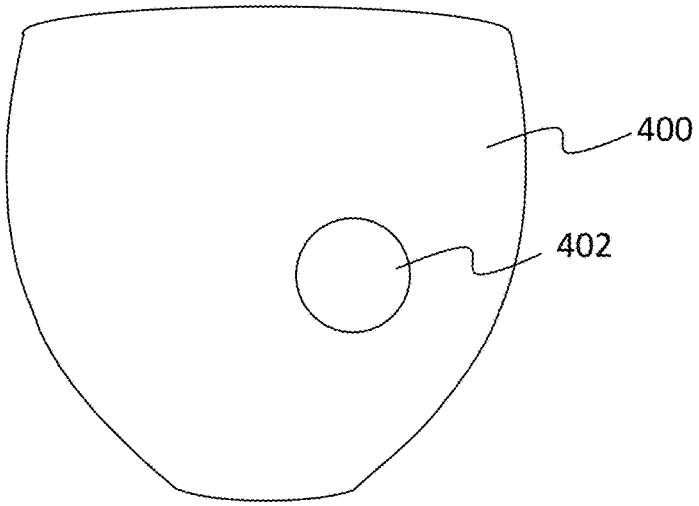
FIG. 4 depicts a fourth exterior frontal view of an insulated beverage container, in accordance with some embodiments of the present disclosure.

FIG. 4 depicts the device of the present disclosure in the form of insulated wine glass sleeve 400. Insulated wine glass sleeve 400 may be configured to fit around the bowl of a wine glass, with an opening at the bottom through which the stem of the wine glass protrudes. Having an open bottom, insulated wine glass sleeve 400 cannot include a false bottom. However, electronic components can be placed along the sides of insulated wine glass sleeve 400. Thus, insulated wine glass sleeve 400 may include an externally marked area 500 which, when pressed by a user, activates a sound synthesizer which plays a pre-recorded or user-recorded song or message. Insulated wine glass sleeve 400 may be made of neoprene or any other suitable insulating material.

While the insulated beverage containers 100, 200, 300, and 400 referenced in FIGS. 1-4 are disclosed as being configured to hold a specific type of beverage container, it will be obvious to one of skill in the art that this device may vary in shape, size, and material. However, all embodiments will be capable of holding or insulating a beverage (i.e., sippy cups and standard beverage glasses as well as insulated beverage cozies designed for wine glasses and beer bottles).

Figure 5:
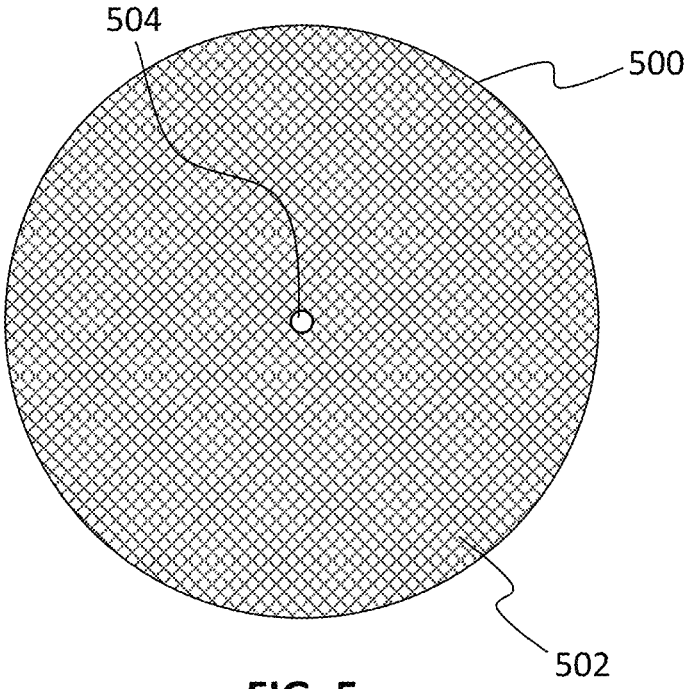
FIGS. 5 and 6 depict exterior bottom views of an insulated beverage cozy, in accordance with some embodiments of the disclosure.
Figure 6:
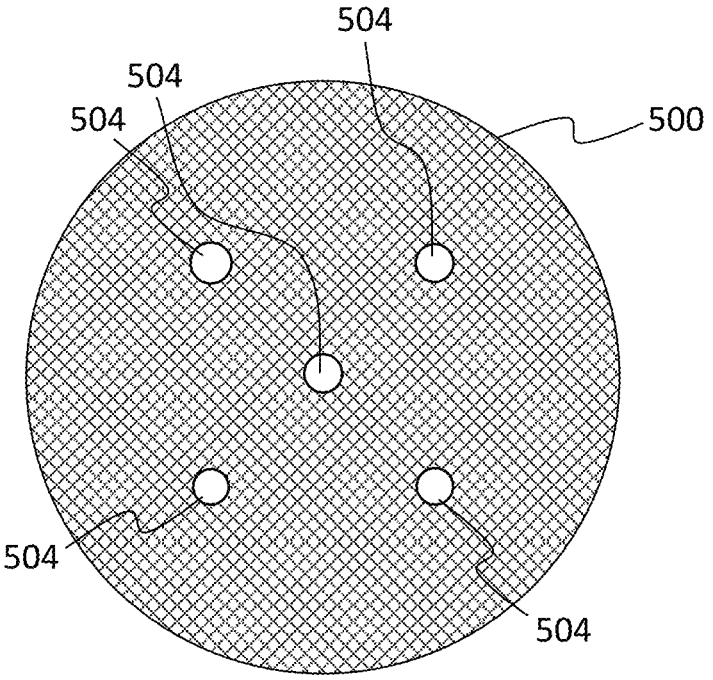

FIGS. 5 and 6 depict a bottom view of an insulated beverage holder 500. Insulated beverage holder 500 may be any of insulated beverage cozy 100, insulated bag 200, or insulated bottle cozy 300. Insulated wine glass sleeve 400 does not have a bottom as depicted in FIG. 5. Insulated beverage holder 500 includes a textured bottom surface 502, which may be comprised on silicone, rubber, or other material with high coefficient of friction, to prevent insulated beverage holder 500 from slipping when placed on a hard surface. Insulated beverage holder 500 may also include at least one hole 504 through which sound generated by the sound synthesizer can be emitted. As shown in FIG. 6, in some embodiments, a plurality of holes 504 are disposed on the bottom surface of insulated beverage holder 500. While five holes are depicted in FIG. 6, any suitable number of holes, being of any suitable size and placed in any suitable locations to enhance the projection of audio from the sound synthesizer may be used.

Figure 7:
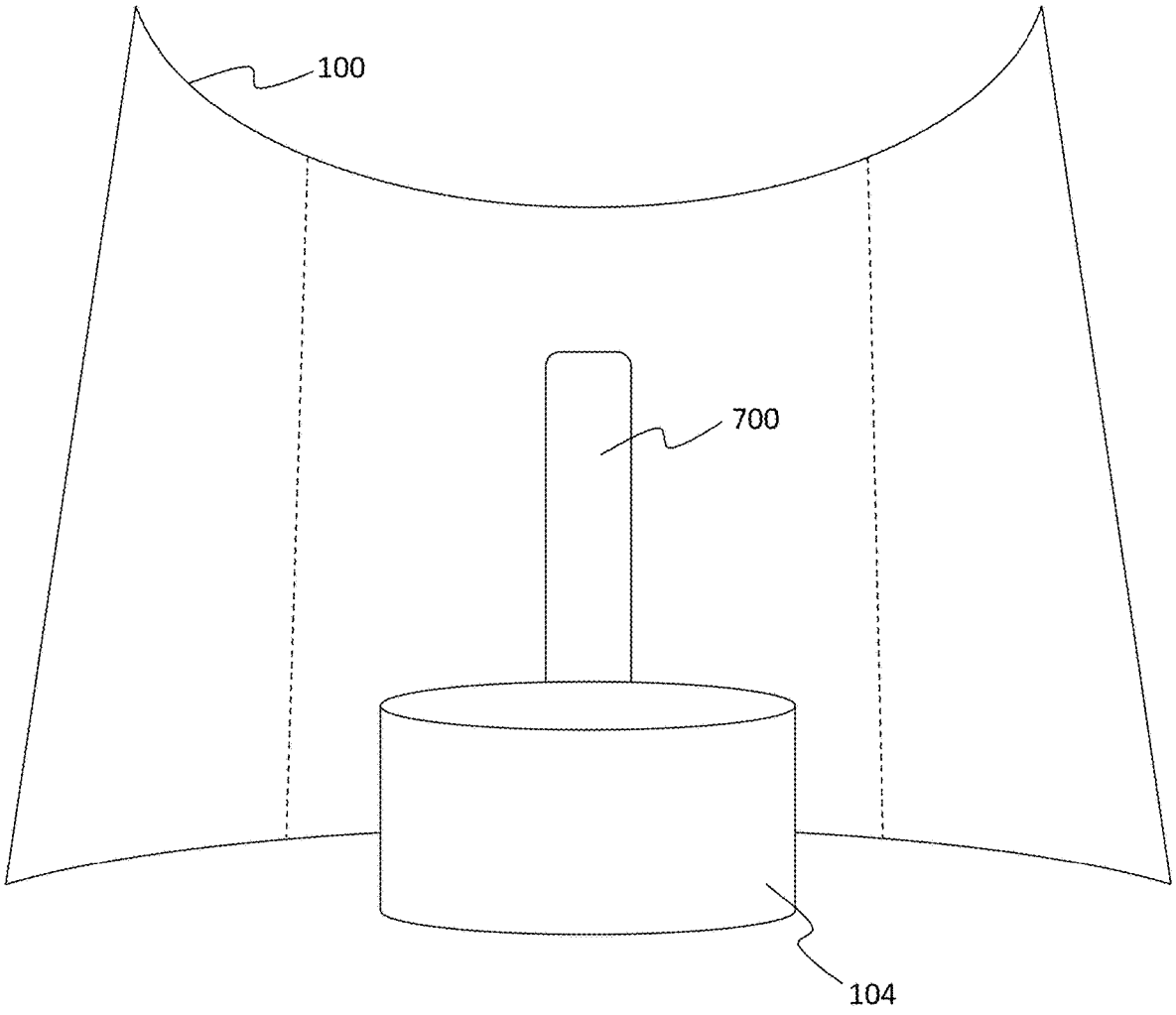
FIGS. 7 and 8 depict a perspective view of the interior of an insulated beverage container, cut open and unfolded to depict certain component features, in accordance with some embodiments of the present disclosure.
Figure 8:
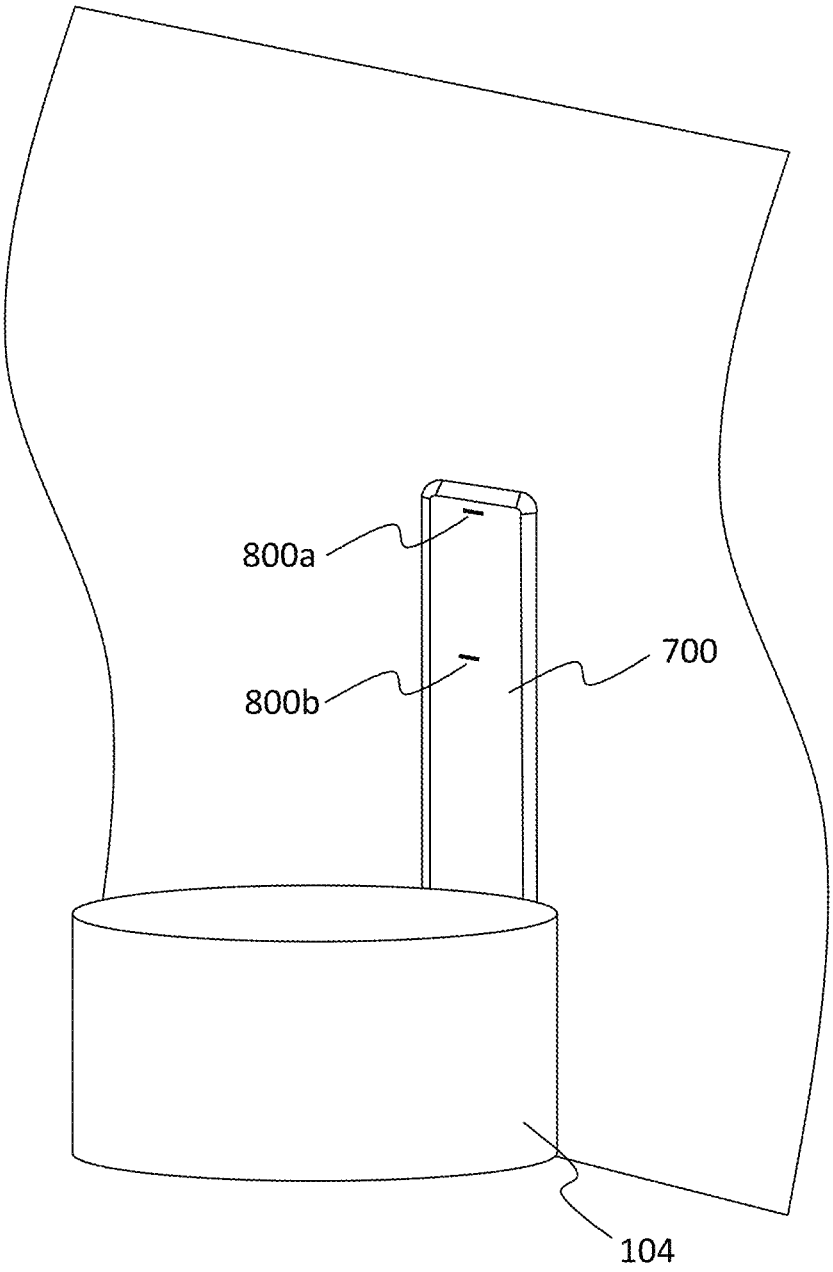

FIGS. 7 and 8 depict perspective views of the interior of insulated beverage cozy 100, cut open and unfolded to depict certain component features, in accordance with some embodiments of the present disclosure. False bottom 104 may be physically coupled or connected to vertical member 700. Vertical member 700 may be composed of a fabric or other soft material to allow for movement of insulated beverage cozy 100. The position of vertical member 700 may be aligned with the externally marked area of insulated beverage cozy 100 and, as further depicted in FIG. 10, may house an on-demand on/off switch and wiring connecting the on-demand on/off switch to control circuitry housed within false bottom 104. As shown in FIG. 8, vertical member 700 may be physically coupled, connected, or otherwise attached to the body of insulated beverage cozy 100 via attachment points 800*a* and 800*b*. For example, vertical member 700 may be sewn to the material of which insulated beverage cozy 100 is composed at attachment points 800*a* and 800*b*, though any suitable attachment method may be used.

Figure 9:
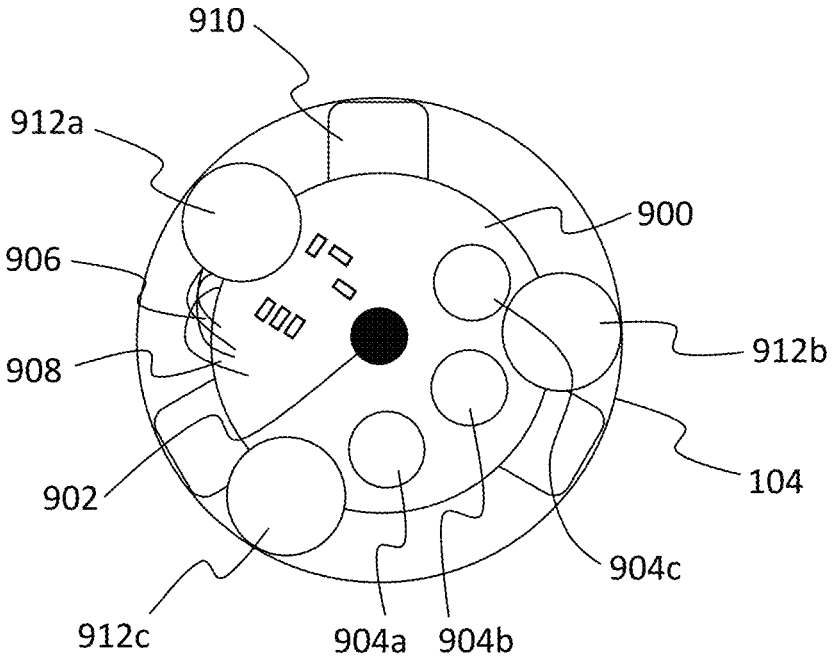
FIGS. 9 and 10 depict a perspective view of the interior of a false bottom of an insulated beverage container, cut open to depict certain component features, in accordance with some embodiments of the present disclosure.
Figure 10:
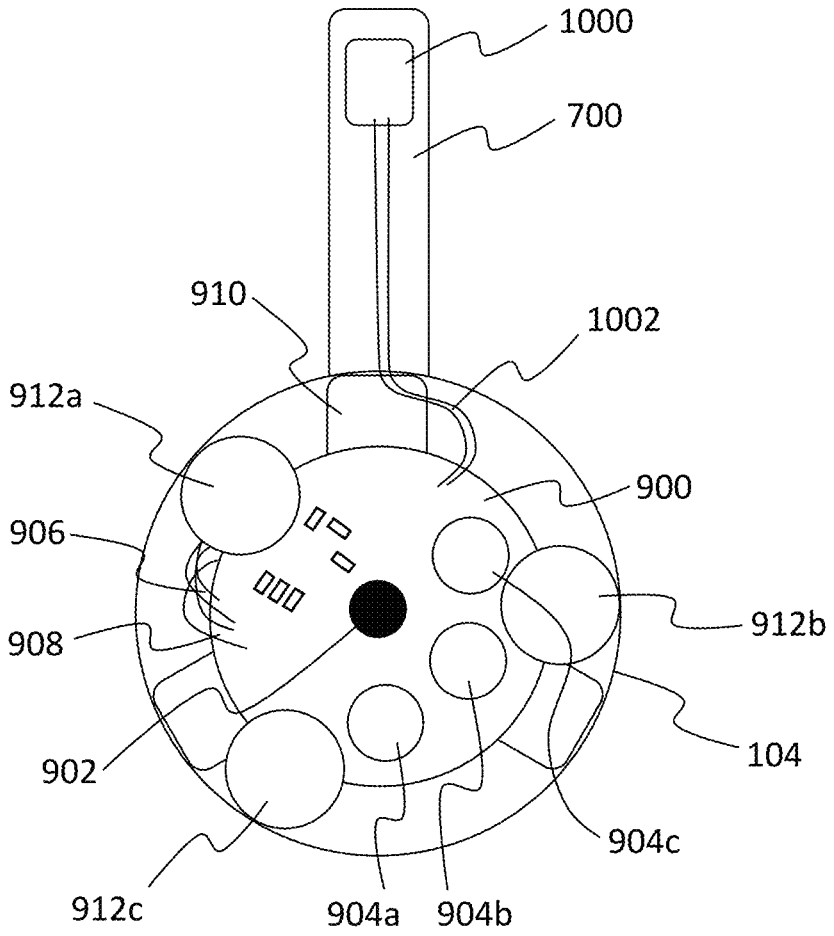

FIGS. 9 and 10 depict a perspective view of the interior of a false bottom 104 of insulated beverage cozy 100, cut open to depict certain component features, in accordance with some embodiments of the present disclosure. False bottom 104 may house control circuitry 900. Control circuitry 900 may be configured to control and operate the sound synthesizer and enable recording and storage of custom audio (i.e., music or messages). Control circuitry 900 may be a printed circuit board having various capacitive, resistive, and amplification components and filters, operatively prearranged and connected to one another in a defined electrical circuit. Control circuitry 900 may further include one or more integrated circuits (ROM chips), such as processor 902, for storage of pre-programmed message information, a digital-to-analogue converter for speech synthesis, and sound projection/amplification means (i.e., a speaker). In some embodiments, processor 902 is a application-specific integrated circuit (ASIC) configured to perform all the functions necessary for the functions of an insulated beverage container of the present disclosure.

As generally recognized, readily available components and circuit designs can be combined to provide a sound synthesizer. Sound synthesis typically involves the combined effects of various electronic components on an electronic signal. In the case of musical synthesizers, the electrical signal undergoes frequency and amplitude shifts to produce discrete musical tones. Electronic synthesis of music can be implemented in various ways utilizing well-known combinations of components in predictive circuit patterns.

A typical electronic configuration, for synthesis of sound of predetermined tone and predetermined pitch for musical reproduction by the synthesizer assembly of the device of this invention, is illustrated in the aforementioned patents. However, whereas in those devices the electrical signal and intensity are controlled by preprogrammed instructions in the memory integrated circuit, the present device allows a user to control the electrical signal by using an on-demand on/off button.

Control circuitry 900 may include a power source, such as batteries 904*a*, 904*b*, and 904*c*. Control circuitry 900 may be electrically connected, via wires 906, to a speaker to enable output of audio from the sound synthesizer. Control circuitry 900 may also be electrically connected, via wires 908, to a microphone to enable recording of custom audio. Control circuitry 900 may be supported by structural member 910. As depicted in FIG. 9, structural member 910 forms a "Y" shape, having three arms, each spaced one hundred and twenty degrees apart. However, structural member 910 may be made in any shape suitable for supporting control circuitry 900. As further depicted in FIG. 10, control circuitry 900 may be electrically connected to on-demand on/off switch 1000 via wires 1002. On-demand on/off switch 1000 may be a tactile switch, a membrane switch, or any other type of switch having a thin profile suitable for placement within an insulated beverage container of the present disclosure. Wires 1002 run from control circuitry 900 to on-demand on/off switch 1000 through vertical member 700. To prevent a beverage placed in insulated beverage cozy 100 from pressing on, and possibly causing damage to, control circuitry 900, supports 912*a*, 912*b*, and 912*c* are placed around the perimeter of false bottom 104 at a level above the tallest component of control circuitry 900.

Figure 11:
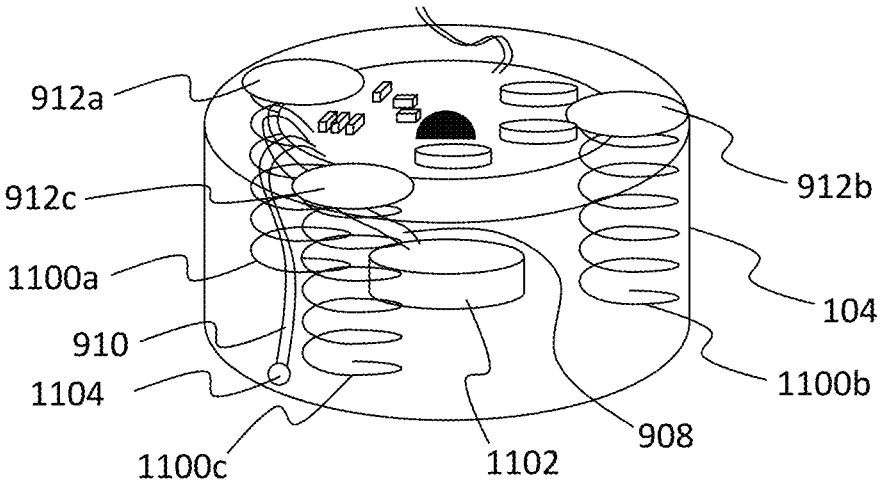
FIG. 11 depicts a profile view of a false bottom of an insulated beverage container, removed from the insulated beverage container to depict certain component features, in accordance with some embodiments of the present disclosure.

FIG. 11 depicts a profile view of a false bottom of an insulated beverage container, removed from the insulated beverage container to depict certain component features, in accordance with some embodiments of the present disclosure. Supports 912*a*, 912*b*, and 912*c* are each connected to the end of compression springs 1100*a*, 1100*b*, and 1100*c*, respectively. Springs 1100*a*, 1100*b*, and 1100*c* provide a force against the weight of a beverage placed in insulated beverage cozy 100. This force helps to prevent damage to control circuitry 900, speaker 1102, and microphone 1104.

Figure 12:
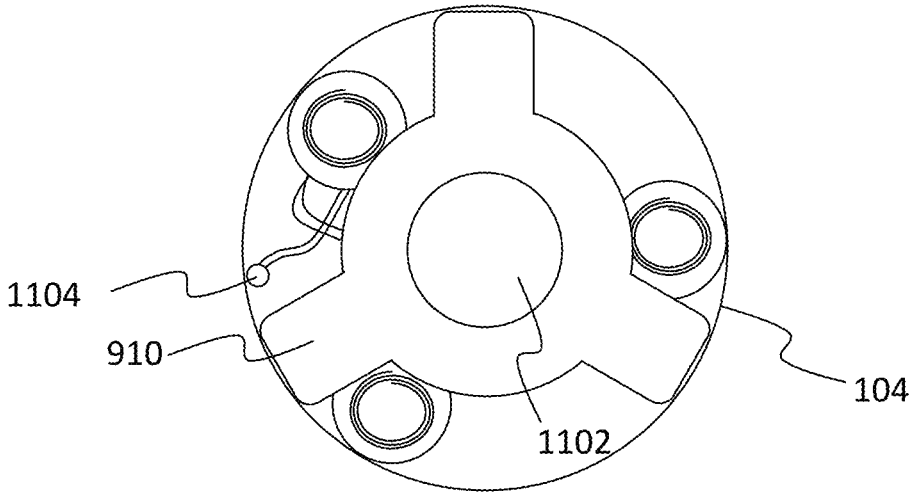
FIG. 12 depicts a bottom view of a false bottom of an insulated beverage container, removed from the insulated beverage container to depict certain component features, in accordance with some embodiments of the present disclosure.

FIG. 12 depicts a bottom view of a false bottom of an insulated beverage container, removed from the insulated beverage container to depict certain component features, in accordance with some embodiments of the present disclosure. Structural member 910 may have a circular hole or recess therein, in which speaker 1102 sits. Structural member 910 may therefore help to prevent damage to speaker 1102 by maintaining the position of speaker 1102 relative to other components of insulated beverage cozy 100.

While the embodiments depicts in FIGS. 7-12 have been described with respect to false bottom 104 of insulated beverage cozy 100, the descriptions can be applied to any of insulated beverage false bottom 104 of cozy 100, false bottom 202 of insulated bag 200, and false bottom 302 of insulated bottle cozy 300. With respect to insulated wine glass sleeve 400, it will be appreciated by those skilled in the art that the components housed in the false bottom as depicted in FIGS. 7-12 may by distributed across an interior surface, or between an exterior surface and an interior surface, of insulated wine glass sleeve 400.

While the invention has been described with reference to the preferred embodiments as illustrated in the accompanying figures, it is recognized by those skilled in the art that modification of the embodiments described herein can be made with departing from the scope or spirit of the invention.

What is claimed is:

1. An insulated beverage cozy or beverage container, comprising:

an electrical sound synthesizer component;

a unitary cylindrical member configured to house the electrical sound synthesizer component;

an on-demand on/off button on the unitary cylindrical member which is electrically connected to the electrical sound synthesizer component via insulated wiring on the interior of the beverage cozy or beverage container; and perforations on the unitary cylindrical member housing the electrical sound synthesizer component.

2. The insulated beverage cozy or beverage container of claim 1, wherein the electrical sound synthesizer is configured to:

store and play pre-loaded music and audio; and allow a user to record and re-play original audio.

3. The insulated beverage cozy or beverage container of claim 1, wherein the unitary cylindrical member further comprises a false bottom configured to house the electrical sound synthesizer component.

* * * * *